US005088523A

United States Patent [19]

Bucher et al.

[11] Patent Number: 5,088,523

[45] Date of Patent: Feb. 18, 1992

[54] HEDDLE SELECTION IN A WEAVING MACHINE FOR RETHREADING

[75] Inventors: Robert Bucher, Frick; Umberto Dünki, Ruti, both of Switzerland

[73] Assignee: Sulzer Brothers Limited, Winterthur, Switzerland

[21] Appl. No.: 589,076

[22] Filed: Sep. 27, 1990

[30] Foreign Application Priority Data

Oct. 3, 1989 [CH] Switzerland ..... 03595/89

[51] Int. Cl.[5] ..... D03J 1/14

[52] U.S. Cl. ..... 139/35; 139/351; 139/353; 28/205

[58] Field of Search ..... 139/35, 351, 353, 369, 139/1 R, 336; 28/206, 207, 205, 209, 211

[56] References Cited

U.S. PATENT DOCUMENTS 4,791,967 12/1988 Vandeweghe et al. ..... 139/353
4,815,498 3/1989 Gryson et al. ..... 139/351
4,817,675 4/1989 Dewaele et al. ..... 139/35

FOREIGN PATENT DOCUMENTS 0259915 3/1988 European Pat. Off. .

*Primary Examiner*—Andrew M. Falik
*Attorney, Agent, or Firm*—Kenyon & Kenyon

[57] ABSTRACT

The device for repairing a yarn break includes a folder blade which is to be inserted between the warp yarns adjacent a broken yarn. During horizontal motion, the folder blade has two wings which diverge outwardly for spreading out the warp yarn. The folder blade also has a longitudinal groove to receive a heddle in the narrowest place between the wings. A sensor on one wing first determines the position of the heddle in the warp direction and generates a signal so that the folder blade comes to a stop with the heddle in the groove of the blade. A separate warp yarn can then be threaded into the heddle by drawing-in tubes.

13 Claims, 4 Drawing Sheets

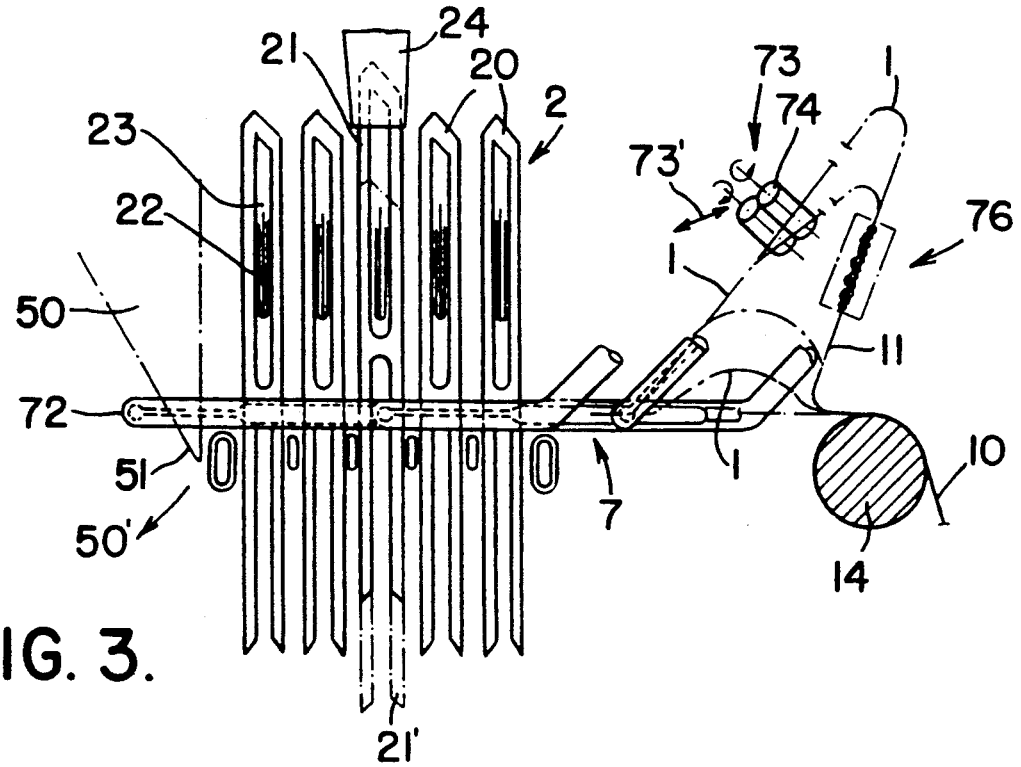
FIG. 3.
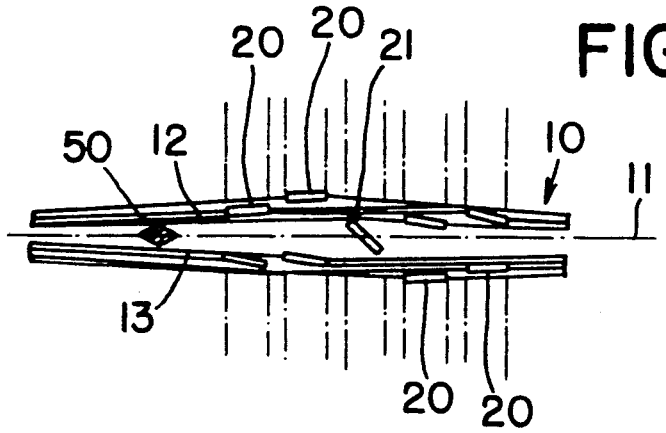
FIG. 3a.
FIG. 3b.
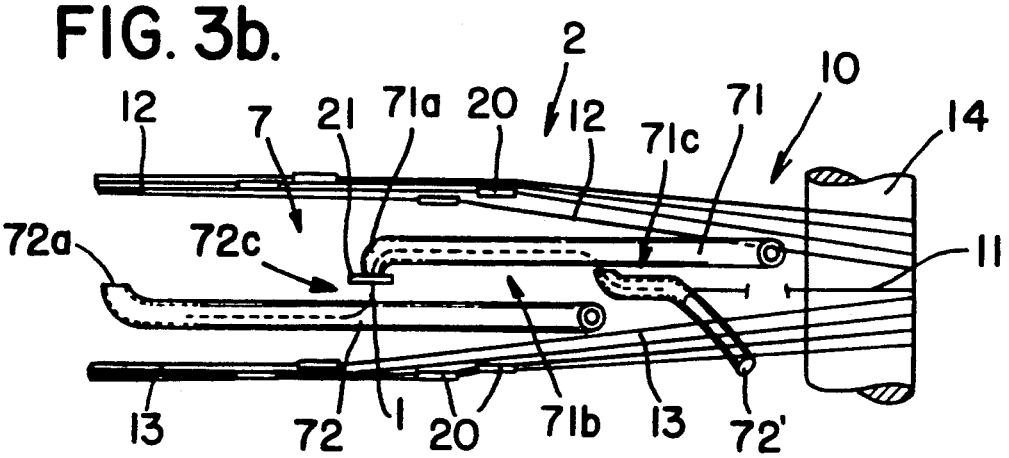

FIG. 4.
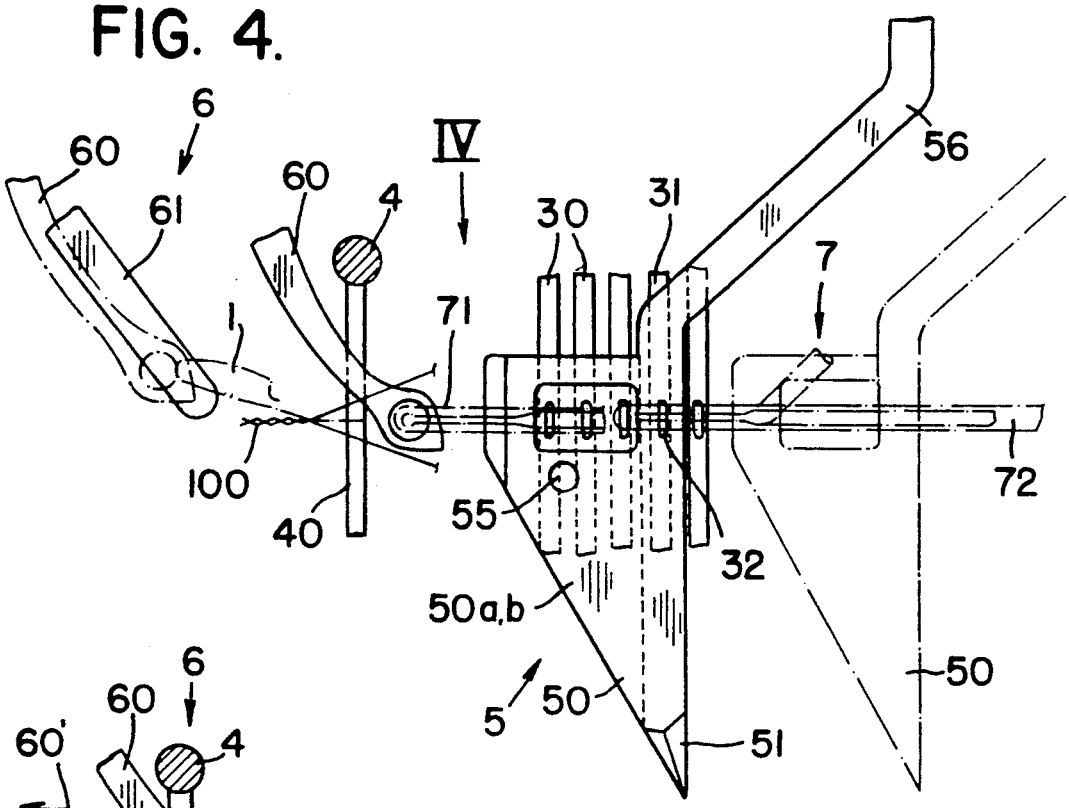
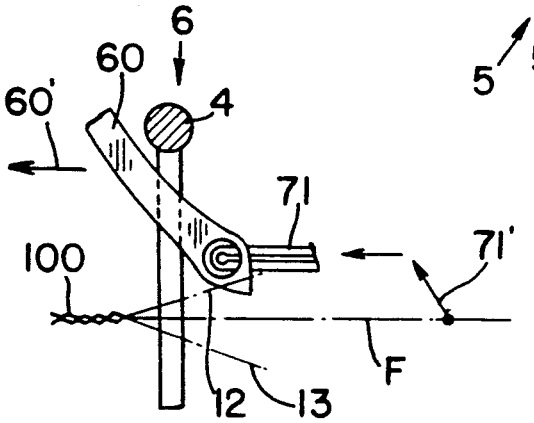
FIG. 4a.
FIG. 4b.
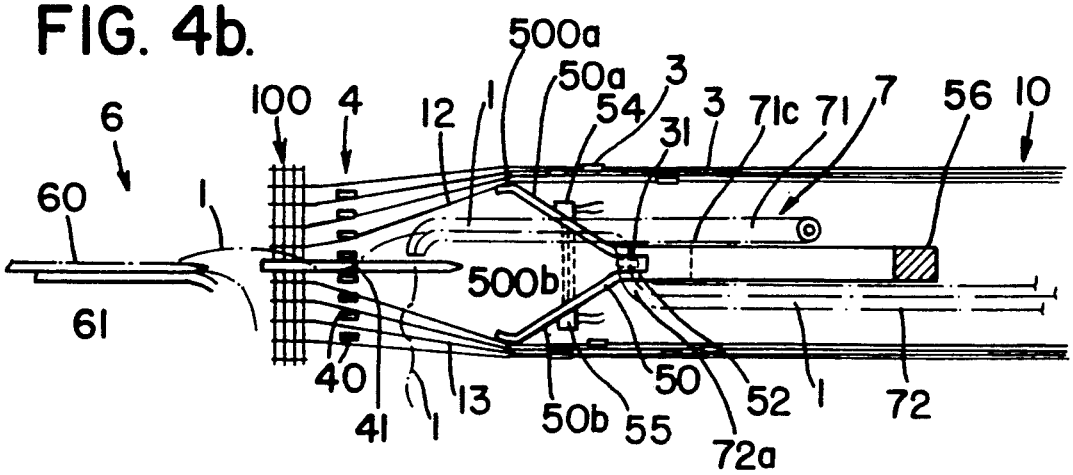

HEDDLE SELECTION IN A WEAVING MACHINE FOR RETHREADING

This invention relates to an apparatus and method for selecting a heddle in a weaving machine for rethreading after a yarn break.

Heretofore, various devices and methods have been known for repairing breaks in a warp yarn in a weaving machine, for example from EP-A-0 259 915 describes a device wherein use is made of a separate warp yarn which can be drawn into the weaving machine for repair purposes. As described, the separate warp yarn is drawn in by a device which moves into a work space between the warp yarns and towards the heddle. However, before the device can be moved in to the work space, a shifting device must first be operated in order to provide a working space for the warp yarns. However, it is not clear as to how the drawing-in device reaches an exact operating position relative to the heddle.

Accordingly, it is an object of the invention to simplify the technique for repairing a broken warp yarn in a weaving machine.

It is another object of the invention to be able to position apparatus for repairing warp yarn brakes in a relatively easy manner relative to a heddle.

It is another object of the invention to be able to accurately control the repairing of the broken warp yarn in a weaving machine.

Briefly, the invention provides an apparatus and method for selecting a heddle in a weaving machine for rethreading.

The apparatus is in the form of a device for selecting a heddle which includes a shaft for positioning between a pair of warp yarns in a position of as broken warp yarn with the shaft having a groove for receiving a heddle. In addition, a sensing means is provided for generating a signal in response to the movement of the device passed a selected heddle and means responsive to the signal for moving the shaft a predetermined amount in order to receive a sensed heddle in the groove.

The device further has a pair of wings which extend from the shaft in a diverging manner and with an increasing width along the shaft in order to spread apart the warp yarns on either side. In this way, the device serves to create a relatively wide space in the warp sheet for subsequent insertion of a drawing-in means. In addition, each wing may be provided with an inwardly turned end directed toward the other wing in order to avoid a sharp deflection of the warp yarns.

The sensing means may employ a light source on one of the wings for directing a beam toward the other wing and a sensor on the other wing for receiving the beam and for generating a signal in response to interruption of the beam by a heddle. In addition, the sensing means may be used to generate a signal in response to insertion of a drawing-in tube into the device for the threading of a fresh warp yarn into an opening of the heddle.

The invention also provides a method of detecting and isolating a heddle in a weaving machine for rethreading. To this end, a device is inserted between two warp yarns in a position of a broken yarn to form a lane between the two warp yarns. The device is then moved in a direction towards the heddle associated with the broken yarn. A signal is subsequently in response to the movement of the inserted device about the selected heddle and the device is thereafter moved in the same direction a predetermined amount so as to arrive at a position corresponding to a set position of the selected heddle. The device then comes to a stop.

A drawing-in tube may then be inserted in the device in alignment with an opening in the heddle positioned in the device. An end of a fresh warp yarn can then be blown from the drawing-in tube through the heddle opening. In this respect, the sensing means may be used to generate a signal in response to insertion of the drawing-in tube into the device at a positioned aligned with the heddle opening.

These and other objects and advantages of the invention will become more apparent from the following detailed description taken in conjunction with the accompanying drawing wherein.

Figures 1, 2, 2A, 2B:
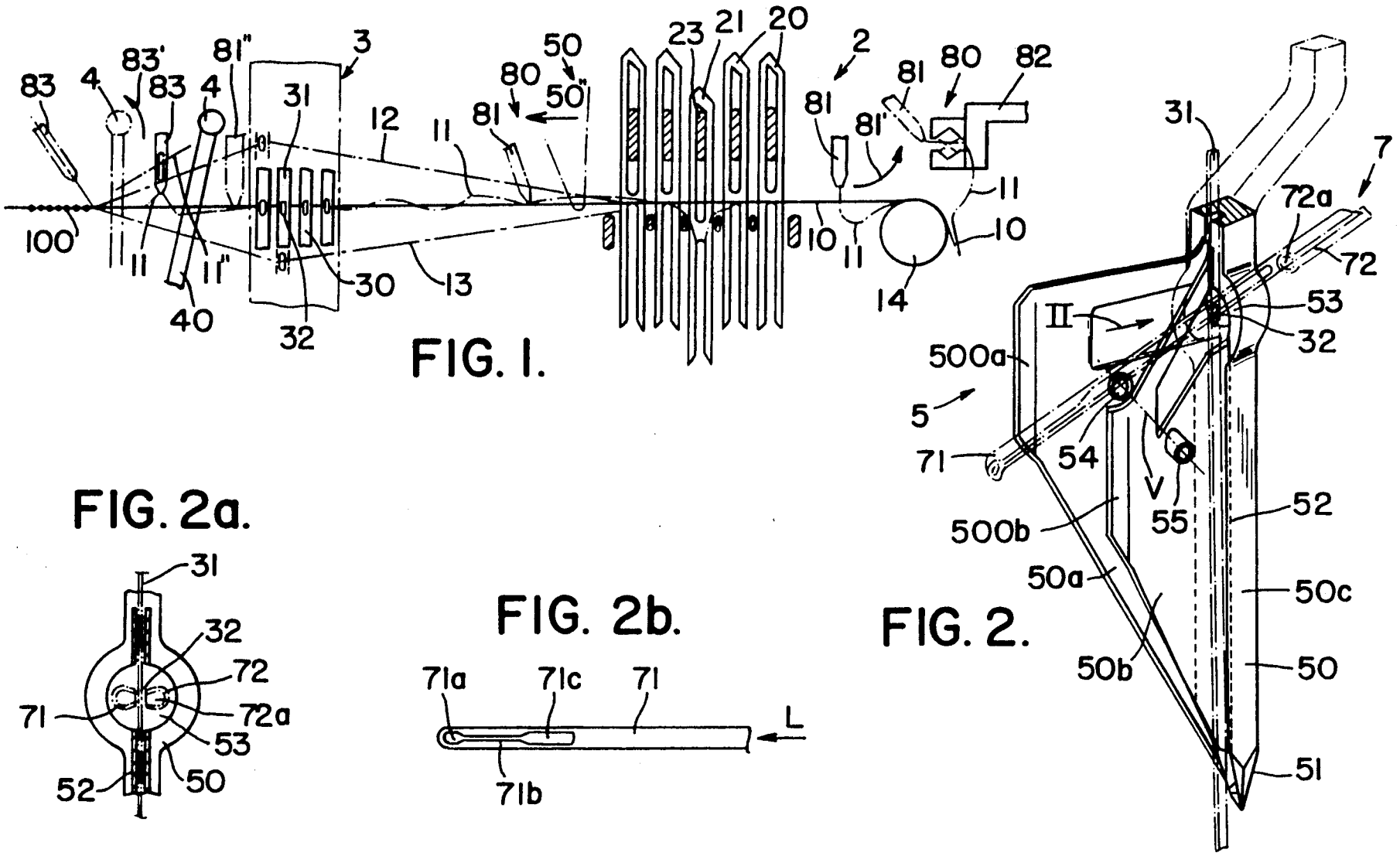
FIG. 1 illustrates a diagrammatic side view of the weaving region of a weaving machine from a whip roll to a woven fabric.
FIG. 2 illustrates a perspective view of a device for selecting and isolating a heddle in accordance with the invention.
Figure 5:
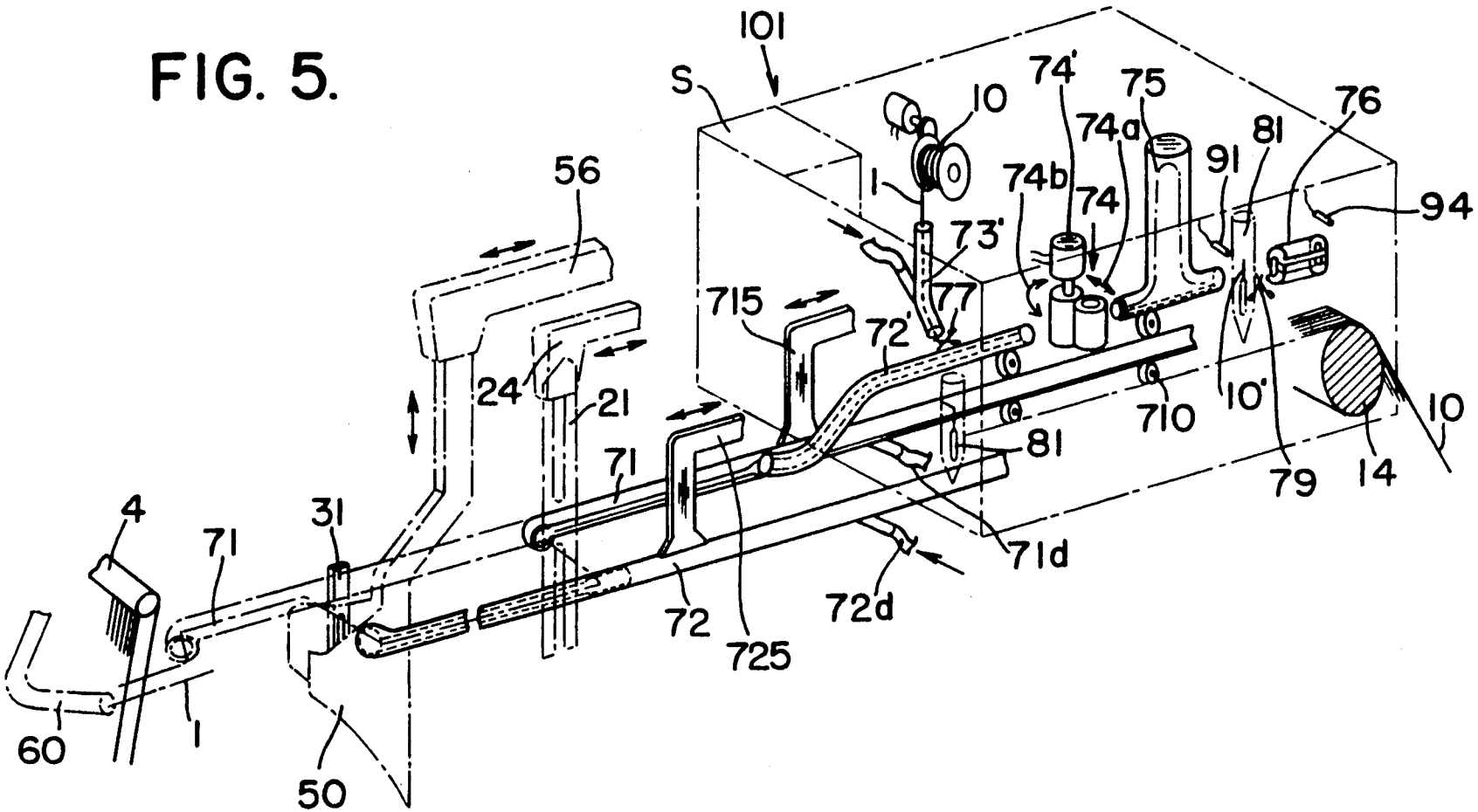

FIG. 2*a* illustrates a partial view of the selecting device taken in the direction indicated by the arrow II in FIG. 2;

FIG. 2*b* illustrates a side view of a drawing-in tube in accordance with the invention;

FIG. 3 illustrates a partial view of the weaving region from the whip roll to a warp-yarn stop-motion;

FIG. 3*a* illustrates a partial plan view of the arrangement in FIG. 3;

FIG. 3*b* illustrates a view of the drawing-in tubes during the process of drawing a warp yarn into a wire of the warp-yarn stop-motion;

FIG. 4 illustrates a partial view of the weaving region around the heddles and the reed of the weaving machine;

FIG. 4*a* illustrates a view of a drawing-in tube during the process of drawing a warp yarn into the reed;

FIG. 4*b* illustrates a plan view of the arrangement in FIG. 4 taken in the direction indicated by the arrow IV; and FIG. 5 diagrammatically illustrates an apparatus for repairing breaks in the warp yarns of a weaving machine in accordance with the invention.

Referring to FIG. 1, a weaving machine is constructed in a conventional fashion for the weaving of a plurality of warp yarns 10 into a cloth 100. As indicated, the warp yarns 10 are passed over a whip roll 14 and directed in a horizontal direction through a warp yarn stop motion 2, a heddle frame 3 and a reed 4.

The warp yarn stop motion 2 has a plurality of wires 20 each of which has an opening for the passage of a warp yarn 10 therethrough. As indicated, one stop motion wire 21 is in a contact position on a contact rail 23 due to the breakage of a warp yarn 11. As illustrated in FIG. 3*a*, the wire 21 and rail 23 may cooperate so that the wire 21 forms a narrow lane in the sheet of warp yarns 10.

The heddle frame 3 is provided with a plurality of heddles for forming a shed with each heddle 30 having an opening 32 for passage of a warp yarn therethrough. As indicated, the heddle 31 has a broken yarn.

The reed 4 is formed of a plurality of guide elements (not shown) for guiding the warp yarns 10 therethrough. As schematically illustrated in FIG. 1, a broken warp yarn 11 is assumed to take up a position such that the associated wire 21 of the stop motion has dropped onto the rail 2 while still being guided through the eye 32 of the heddle 31. The adjacent warp yarns 12, 13 are indicated as being in a top shed position and a bottom shed position, respectively. However, these adjacent warp yarns 12, 13 may be in the same shed position.

As indicated in FIG. 1, after a yarn break has been signalled, a device 50 for selecting and isolating the heddle 31 to be re-threaded with a fresh warp yarn is introduced in the lane defined by the broken yarn 11 in order to widen the lane by spreading out the warp yarns to either side.

Referring to FIG. 2, the device 5 is in the form of a folder blade 50 having a pair of wings 50*a*, 50*b* extending in a diverging manner from a vertical shaft 50*c* above a pointed tip 51 and which become wider with increasing height along a vertical shaft 50*c*. Each wing 50*a*, 50*b* has an inwardly turned end 500*a*, 500*b* so that when the folder blade 50 is pushed inside the warp sheet, the individual warp yarns 12, 13 are not abruptly deflected. The folder blade 50 also has a groove 52 extending vertically within the shaft 50*c* for receiving a heddle 31.

A sensing means is also provided on the folder blade 50 for sensing the movement of the folder blade 50 about a heddle 31. As indicated, the sensing means includes a sensor 54 and a light source 55 disposed opposite one another on the wings 50*a*, 50*b* in front of the shaft 50*c* taken in the direction of motion in the folder blade 50. When the folder blade 50 moves in the direction indicated by the arrow 50'' indicated in FIG. 1, the sensor 54 and light source 55 generate a signal when the heddle 31 is aligned with the beam or line V defined between the sensor 54 and light source 55. The folder blade 50 is then moved only by the further distance between the beam V and the groove 52 in the shaft 50*c* so that the folder blade 50 comes to a stop as the heddle 51 is inserted into the groove 52.

As indicated in FIGS. 2 and 2*a*, the folder blade 50 is provided with an opening 53 of circular shape for purposes as described below and is mounted on a arm 56 which extends from a repair apparatus (FIG. 5).

Before penetrating into the warp 10, the folder blade 50 is adjusted horizontally in the weft direction of the weaving machine and at the height of the stop motion wires 20 by a suitable drive (not shown). The position of the stop motion wire 21 and, consequently, the desired position of the folder blade 50 can be determined, for example, by a special commercial warp yarn stop motion by determining the resistance of a wire in the weft direction from one side of the stop motion 2 to the place of contact with the wire 21. The position of the stop motion wire can be determined in a simple manner as the resistance per unit length of the resistance wire is known.

Referring to FIG. 5, wherein like reference characters indicate like parts as above, the repair apparatus is mounted on the weaving machine with a pair of elongated drawing-in tubes 71, 72 extending above the plane of the warp yarns. Each tube 71, 72 is carried by an arm 715, 725, respectively and each is guided for longitudinal motion by a plurality of rollers 710 within a housing 101 of the repair apparatus which can be moved in the direction of the weft yarn by suitable means (not shown). The housing 101 also contains a control means S for controlling the various motions of the repair apparatus. The arms 715, 725, rollers 710 and drive (not shown) constitute a means for moving the tubes 71, 72 in parallel to each other for purposes as explained below.

As illustrated in FIG. 2*b*, one tube 71 is provided with a blowing opening 71*a* from which an end of a fresh yarn can be ejected, a suction opening 71*c* into which a warp yarn can be drawn and a slot 71*b* which extends between the two openings 71*a*, 71*c* to permit movement of a warp yarn laterally out of the tube 71. The other tube 72 is constructed in similar fashion. As indicated in FIG. 2*a*, the tubes 71, 72 are sized so as to pass through the opening 53 in the folder blade 50.

Referring to FIG. 2*b*, an air flow L through the tube 71 produces a negative pressure at the suction opening 71*c* and leaves the tube through the blowing opening 71*a*, the flow being deflected at right angles to the longitudinal extent of the tube 71. The fresh warp yarn 1 can be pulled out of the tube 71 through the slot 71*b* at the end of a threading-end process. Suction of the fresh warp yarn 1 into the suction opening 71*c* is assisted in that the blowing opening 72*a* of the other tube 72 is disposed opposite the suction opening 71*c*.

Referring to FIG. 5, a pair of air connections 71*d*, 72*d* are provided for the respective tubes 71, 72 for intermittently supplying blowing air to each. The program for switching the blowing air on and off for the tubes 71, 72 is stored in the control unit 5.

The repair apparatus also includes a warp yarn store means within the housing 101 for holding a predetermined length of a fresh warp yarn as well a pneumatic tube 72' for conveying the fresh warp yarn from the store means into the first tube 71 for subsequent conveyance to the second tube 72.

As illustrated, the warp yarn store means includes a fresh warp yarn spool 10' from which fresh warp yarn 1 is drawn off into a tube 73' and introduced into the pneumatic tube 72' the air connection in the pneumatic tube 72' is such as to blow the fresh warp yarn 1 into and between a pair of rollers 74 which grip and deliver the yarn to a yarn store 75 through which the yarn 1 runs horizontally until passing a sensor 91.

Upon initiation of picking of a weft thread (not shown), the sensor 91 delivers a signal to the control means S and starts up a counter which records the rotations of a drive motor 74' at the rollers 74. The rollers 74 then continue to run for a predetermined number of revolutions of the motor 74' or until a preset length of the fresh warp yarn 1 has been reached. Meanwhile, the tip of the warp yarn 1 has travelled through the store 75 into a splicer 76 which grips the tip of the yarn after a sensor 94 positioned to the right of the splicer 75, as viewed, has delivered a signal when the warp yarn passes by. During subsequent conveyance of the yarn through the rollers 74, a supply of the fresh warp yarn will form in the store 75.

The stored yarn is then maintained for use in a repair operation. After a repair operation is completed, the yarn store is replenished.

Referring to FIG. 1, a suction means 80 in the form of a suction tube 81 is provided to grip the end of the broken warp yarn 11 on the warp side. Initially, the suction nozzle 81 is in the same position as the folder blade 50 over the lane formed between the warp yarns 12, 13. The suction nozzle 81 pivots in the direction indicated by the arrow 81' towards a cutting and holding device 82 where the portion of the warp yarn 11 held by the suction nozzle 81 is deposited and cut in order to be connected to a fresh warp yarn 1 in a subsequent operation. As indicated in FIG. 5, the suction nozzle 81 lays the cut end of the broken yarn in the splicer 76 where the broken yarn end is joined to the tip of the fresh warp yarn 1. The end of the broken warp yarn 10' in the suction nozzle 81 can then be cut off by a cutter 79.

The end of the broken warp yarn 11 on the other side of the stop motion 2 is likewise gripped and pulled up by a suction means 80 in the form of a second suction nozzle 81. This is necessary to prevent the broken warp yarn 11 from becoming jammed on the front side of the holder blade 50 when the blade 50 is moved in the direction indicated by the arrow 50''.

In operation, after a broken yarn has been sensed in the stop motion 2, for example, by dropping of a wire 21 onto the rail 23, the two suction nozzles 81 grip the respective broken ends of the warp yarn and move the broken ends away from the stop motion 2. The folder blade 50 is then moved into the plane of the warp yarns with the shaft tip 51 penetrating into the lane defined by the now missing warp yarn. The folder blade 50 is then moved towards the heddle 31 corresponding to the broken yarn into a position as shown in FIG. 4*b* so as to provide a free working space in the region of the heddles 30. As indicated, the heddles 30 and the warp yarns passing therethrough are moved to the side except for the heddle 31 into which the fresh warp yarn 1 is to be threaded. As the wings 50*a*, 50*b* of the folder blade 50 move past the heddle 31, the sensing means 54, 55 emits a signal to the control S (see FIG. 5) so that the subsequent movement of the folder blade 50 is terminated at a position in which the heddle 31 occupies the groove 52 as illustrated in FIG. 2.

After the sensor 54 has detected the position of the heddle 31 and the folder blade 50 has come to a stop after insertion of the heddle 31, the threading-in positions for the tubes 71, 72 is determined. To this end, the control means S (see FIG. 5) registers the movement of an arm 56 on which the folder blade 50 is mounted and adjusts the arms 715, 725 of the threading-in tubes 71, 72 so that the tubes 71, 72 can reach the threading-in position in the case of the heddle 31.

Referring to FIG. 3, the tubes 71, 72 of the threading-in device 7 are initially positioned relative to the wire, 21 of the stop motion device 2 for threading-in of the fresh warp yarn 1 into the opening of the wire 21. As indicated in FIG. 3*b*, the pneumatic tube 72' which receives the fresh warp yarn from the store 75 (see FIG. 1) is positioned to blow the fresh warp yarn 1 into the suction opening 71*c* of one tube 71. The yarn is then conveyed pneumatically along the tube 71 and blown from the blowing opening 71*a* through the opening of the wire 21 into the suction opening 72*c* of the second tube 72. The fresh warp yarn 1 is further blown along the length of the tube 72 into the position illustrated in FIG. 3*b*.

As indicated in FIG. 3, during the process of drawing in the fresh warp yarn 1 to the wire 21 of the stop motion 2, the folder blade 50 has penetrated into the warp plane by moving in the direction indicated by the arrow 50' and has formed a widened lane as indicated in FIG. 3*b*. FIG. 3*a* illustrates the movement when the folder blade 50 enters between the warp yarns 12, 13 adjacent the broken yarn 11. The stop motion wire 21 slopes in its bottom position 21' (shown in dotted line in FIG. 3) thus forming the lane for inserting the folder blade 50 between the neighboring warp yarns. The sloped position of the wire 21 can be obtained by means of angled slots in the contact rail 23 and by moving the contact rail 23 and a supporting rail 22 in the longitudinal direction relative to one another. A stop motion of this kind is described in Swiss Patent 169,657. In addition, a holder 24 is provided for gripping and lifting the wire 21 for the next drawing-in operation.

After threading in of the fresh warp yarn 1 into the wire 21 of the stop motion 2, the foremost tube 72 is positioned with the blowing opening 72*a* in alignment with the opening 32 in the heddle 31 as indicated in FIGS. 2, 4*b* and 5. In the position shown in FIG. 2, the tube 71 passes through the opening 53 in the folder plate 50 while the tube 72 has the blowing opening 72*a* aligned with the opening 32 in the heddle 31. In this respect, the sensor 64 and light source 55 are used to position the tube 72 for threading of a yarn into the opening (eye) 32 of the heddle 31. The forward end of the yarn is then blown into the suction opening 71*a* of the tube 71 which is also aligned with the opening 32 of the heddle 31.

In order to draw the fresh warp yarn into the reed 4, the travelling tube 71 is moved forwardly into the dotted line position illustrated in FIGS. 4 and 5. A guide 60 having an opening for passage of a warp yarn is pivoted through the reed 4 between the guide elements thereof into the position as shown in FIG. 4*a*. In this position, the guide 60 comes into registry with the tube 71 such that the opening therein is aligned with the blowing opening of the tube 71. Thereafter, air is blown into the tube 72 (see FIG. 4) so as to blow the fresh warp yarn into the tube 71 in a manner as described above 4*b*). Thereafter, the guide 60 can be pivoted back through the reed 4 into the position on the opposite side of the reed 4. In this respect, a gripper 61 is provided on the guide 60 for retaining the threaded warp yarn.

As indicated in FIG. 4*a*, the tube 71 and guide 60 are disposed above the top warp yarn 12 so that the threading-in process can proceed without hinderance. As mentioned, all the warp yarns 12, 13 can lie horizontally or the position of the fabric 100 can be changed by being pulled downwardly. To this end, a fabric support (not shown) can be moved downwardly or all of the heddles 30 can be moved downwardly, in which case, the guide 60 can remain at the level of the shed closing position F indicated in FIG. 4*a*. Thereafter, the guide 60 is pulled back through the shed 4 in the direction indicated by the arrow 60' until the fresh threaded-in warp yarn 1 is above the fabric 100.

Referring to FIG. 1, the part of the broken warp yarn 11 in front of the heddles 31 of the heddle frame 3 can be gripped by a suction nozzle 81'' and drawn into the position 11''' near the reed 4. In this top position, the broken warp yarn end can easily be gripped by a further suction nozzle 83 as the yarn end is disposed above the warp yarns 12. The broken end can then be pulled forwardly over the woven fabric 100 by the suction nozzle 83.

Advantageously, the warp 10 is adjusted into the shed closing position with all of the heddle eyes 32 being disposed at the same height as in FIG. 1.

As indicated in FIG. 5, the folder blade 50 is moved horizontally and vertically by the arm 56 in the direction indicated by the arrows while the threading-in tubes 71, 72 are moved horizontally by the arms 715, 725.

Referring to FIG. 5, at the end of the process of conveying and storing the fresh warp yarn 1, the rollers 74 stop and reverse their direction of movement as indicated by the arrow 74*b*. At the same time, air is blown into the auxiliary pneumatic tube 72' in the direction for conveying to the drawing-in tube 71.

At this time, a cutter 77 serves to cut the length of fresh warp yarn 1 to a predetermined length for subsequent insertion into a broken warp yarn.

As a result of the backward rotation of the rollers 74, the fresh warp yarn 1 is moved towards the tube 71 in a controlled manner via the tube 72' which is slotted along the entire length thereof as indicated in dotted line. The fresh warp yarn 1 is then, as described, blown into the stop motion wire 21 and then into the tube 72.

The invention thus provides an apparatus and method for selecting and isolating a heddle in a completely automatic manner for repairing a warp yarn break.

The invention further provides an apparatus which can readily isolate a heddle in a relatively large working space to repair a broken warp yarn.

What is claimed is:

1. A device for selecting a heddle in a weaving machine for re-threading, said device comprising a shaft for positioning between a pair of warp yarns in a weaving machine in a position of a broken warp yarn, said shaft having a groove for receiving a heddle therein;

a sensing means for generating a signal in response to movement of the device past a heddle; and means responsive to said signal for moving said shaft a predetermined amount to receive a sensed heddle in said groove.

2. A device as set forth in claim 1 which further comprises a pair of wings extending from said shaft in a diverging manner and with an increasing width along said shaft to spread apart the warp yarns on either side thereof.

3. A device as set forth in claim 2 which further comprises a pointed tip at one end of said shaft for penetrating between a pair of adjacent warp yarns.

4. A device as set forth in claim 2 wherein each wing has an inwardly turned end directed toward the other of said wings.

5. A device as set forth in claim 2 wherein said sensing means includes a light source mounted on one of said wings for directing a beam toward the other wing and a sensor on said other wing for receiving said beam and for generating said signal in response to interruption of said beam by a heedle.

6. A device for selecting a heddle in a weaving machine comprising a shaft for positioning between a pair of warp yarns in a weaving machine in a position of a broken warp yarn, said shaft having a groove for receiving a heddle therein; and a pair of wings extending from said shaft in a diverging manner and with an increasing width along said shaft to spread apart the warp yarns on either side thereof.

7. A device as set forth in claim 6 which further comprises a pointed tip at one end of said shaft for penetrating between a pair of adjacent warp yarn.

8. A device as set forth in claim 7 wherein each wing has an inwardly turned end directed toward the other of said wings.

9. A method of detecting and isolating a heddle in a weaving machine for re-threading comprising the steps of inserting a device between two warp yarns in a weaving machine in a position of a broken warp yarn to form a lane between said two warp yarns;

moving the inserted device in a direction towards a selected heddle associated with the broken yarn;

generating a signal in response to movement of the inserted device about the selected heddle; and thereafter moving the device in said direction a predetermined amount to a position corresponding to a set position of the selected heddle.

10. A method as set forth in claim 9 which further comprises the step of widening said lane to provide a space for drawing-in a fresh warp yarn.

11. A method as set forth in claim 10 which further comprises the step of inserting a drawing-in tube in the device in alignment with an opening in a heddle positioned in the device and blowing an end of a fresh warp yarn from the tube through the heddle opening.

12. A method as set forth in claim 11 which further comprises the step of generating a signal in response to insertion of the drawing-in tube into the device at a position aligned with the heddle opening.

13. A method as set forth in claim 9 wherein said direction is a horizontal position.

* * * * *

UNITED STATES PATENT AND TRADEMARK OFFICE

CERTIFICATE OF CORRECTION

PATENT NO. : 5,088,523

DATED : February 18, 1992

INVENTOR(S) : Bucher et al.

It is certified that error appears in the above-identified patent and that said Letters Patent is hereby corrected as shown below:

Column 1, line 10, change "example from EP-" to --example, EP- -- line 16, change "in to" to --into-- line 40, change "passed" to --past--

Column 2, line 10, change "positioned" to --position-- line 68, change "2" to --23--

Column 3, line 41, change "a" to --an--

Column 4, line 36, change "72' the" to --72'. The--

Column 5, line 36, change "is" to --are-- line 43, change "wire," to --wire--

UNITED STATES PATENT AND TRADEMARK OFFICE

CERTIFICATE OF CORRECTION

PATENT NO. : 5,088,523

DATED : February 18, 1992

INVENTOR(S) : Bucher et al.

It is certified that error appears in the above-identified patent and that said Letters Patent is hereby corrected as shown below:

Column 6, line 30, change "above 4b)." to --above and thereafter through the opening in the guide 60 (See FIG. 4B).--

Column 8, line 15, change "yarn" to --yarns.--

Signed and Sealed this

Ninth Day of November, 1993

*Attest:*

*Attesting Officer*

Bruce Lehman

BRUCE LEHMAN

*Commissioner of Patents and Trademarks*